US006811575B2

(12) United States Patent
Ho et al.

(10) Patent No.: US 6,811,575 B2
(45) Date of Patent: Nov. 2, 2004

(54) METHOD FOR MARKING HYDROCARBONS WITH ANTHRAQUINONES

(75) Inventors: Kim Sang Ho, Richboro, PA (US); Yu-Min Chen, Belmont, MA (US)

(73) Assignee: Rohm and Haas Company, Philadelphia, PA (US)

( * ) Notice: Subject to any disclaimer, the term of this patent is extended or adjusted under 35 U.S.C. 154(b) by 139 days.

(21) Appl. No.: 10/308,618

(22) Filed: Dec. 3, 2002

(65) Prior Publication Data

US 2003/0126694 A1 Jul. 10, 2003

Related U.S. Application Data

(60) Provisional application No. 60/342,638, filed on Dec. 20, 2001.

(51) Int. Cl.[7] ..... D06P 3/00; G01N 37/00

(52) U.S. Cl. ..... 8/521; 436/56; 436/328; 252/408.1; 44/312

(58) Field of Search ..... 8/521; 436/56, 436/328; 252/408.1; 44/312

(56) References Cited

U.S. PATENT DOCUMENTS

| | | | | |
|---|---|---|---|---|
| 2,611,772 A | * | 9/1952 | Allen et al. | 552/255 |
| 3,164,449 A | * | 1/1965 | Buxbaum | 44/312 |
| 3,926,835 A | | 12/1975 | Tucker | 252/300 |
| 4,436,641 A | | 3/1984 | Stelz et al. | 252/68 |
| 4,446,047 A | | 5/1984 | Thompson | 252/299.1 |
| 4,585,574 A | | 4/1986 | Blunck et al. | 252/299 |
| 4,755,012 A | | 7/1988 | Kojima | 350/1.1 |
| 5,342,974 A | | 8/1994 | Ohyama et al. | 552/259 |
| 5,525,516 A | | 6/1996 | Krutak et al. | 436/56 |
| 5,663,386 A | | 9/1997 | Raulfs et al. | 552/241 |
| 5,804,447 A | | 9/1998 | Albert et al. | 436/56 |
| 5,882,358 A | | 3/1999 | Smith et al. | 8/527 |
| 5,955,564 A | | 9/1999 | Weaver et al. | 528/223 |
| 5,962,557 A | | 10/1999 | Weaver et al. | 524/35 |
| 6,274,381 B1 | | 8/2001 | Pauls et al. | 436/56 |
| 6,312,958 B1 | | 11/2001 | Meyer et al. | 436/56 |

FOREIGN PATENT DOCUMENTS

| | | | |
|---|---|---|---|
| DE | 381605 | * | 10/1988 |
| DE | 3835489 | | 10/1988 |
| EP | 0201368 A1 | | 11/1986 |
| EP | 338311 | * | 10/1989 |

OTHER PUBLICATIONS

Jurgen Fabian, Hiroyuki Nakazumi and Masaru Matsuoka: Near–Infrared Absorbing Dyes: Chem. Rev. 1992: vol. 92, No. 6; p. 1197–1226; 1992.

* cited by examiner

*Primary Examiner*—Margaret Einsmann
(74) *Attorney, Agent, or Firm*—Kenneth Crimaldi

(57) ABSTRACT

Method for invisibly marking a liquid petroleum hydrocarbon. The method comprises adding to the liquid petroleum hydrocarbon at least one dye selected from the group consisting of 1,4,5,8-tetrasubstituted anthraquinones and anthraquinone dimers. The absorption maximum of the dye(s) is in the range from 710 nm to 850 nm.

12 Claims, No Drawings

METHOD FOR MARKING HYDROCARBONS WITH ANTHRAQUINONES

CROSS REFERENCE TO RELATED PATENT APPLICATIONS

This is a non-provisional application of prior now abandoned, U.S. provisional application Ser. No. 60/342,638 filed Dec. 20, 2001.

BACKGROUND

This invention relates generally to a method for marking petroleum hydrocarbons with anthraquinone compounds for subsequent identification.

U.S. Pat. No. 4,755,012 discloses a ray absorption filter comprising a 1,4,5,8-tetra(arylamino)anthraquinone. This reference, however, does not suggest a method for marking petroleum hydrocarbons.

Phthalocyanine dyes having absorption maxima above 700 nm are known as petroleum markers, but these materials suffer from disadvantages, including difficulty of preparation and high cost. The problem addressed by this invention is to find an improved method for marking petroleum hydrocarbons with compounds having an absorption maximum above 700 nm.

STATEMENT OF INVENTION

The present invention is directed to a method for invisibly marking a liquid petroleum hydrocarbon. The method comprises adding to the liquid petroleum hydrocarbon at least one dye selected from the group consisting of 1,4,5,8-tetrasubstituted anthraquinones and anthraquinone dimers. The absorption maximum of the dye(s) is in the range from 710 nm to 850 nm.

DETAILED DESCRIPTION

All percentages are weight percentages, unless otherwise indicated. Concentrations in parts per million ("ppm") are calculated on a weight/volume basis. The term "petroleum hydrocarbons" refers to products having a predominantly hydrocarbon composition that are derived from petroleum, preferably lubricating oil, brake fluid, hydraulic fluid, gasoline, diesel fuel, kerosene, jet fuel and heating oil. An "alkyl" group is a hydrocarbyl group having from one to twenty carbon atoms in a linear, branched or cyclic arrangement. Alkyl groups optionally have one or more double or triple bonds. Substitution on alkyl groups of one or more halo, hydroxy or alkoxy groups is permitted; alkoxy groups may in turn be substituted by one or more halo substituents. Preferably, alkyl groups have no halo or alkoxy substituents. A "heteroalkyl" group is an alkyl group having at least one carbon has been replaced by O, NR, or S, wherein R is hydrogen, alkyl, aryl or aralkyl. An "aryl" group is a substituent derived from an aromatic hydrocarbon compound. An aryl group has a total of from six to twenty ring atoms, and has one or more rings which are separate or fused. An "aralkyl" group is an "alkyl" group substituted by an "aryl" group. A "heterocyclic" group is a substituent derived from a heterocyclic compound having from five to twenty ring atoms, at least one of which is nitrogen, oxygen or sulfur. Preferably, heterocyclic groups do not contain sulfur. Substitution on aryl or heterocyclic groups of one or more halo, cyano, hydroxy, alkyl, heteroalkyl or alkoxy groups is permitted, with substitution by one or more halo groups being possible on alkyl, heteroalkyl or alkoxy groups. Preferably, aryl and heterocyclic groups do not contain halogen atoms. An "aromatic heterocyclic" group is a heterocyclic group derived from an aromatic heterocyclic compound.

In a preferred embodiment of the invention, a 1,4,5,8-tetrasubstituted anthraquinone dye having formula (I) is added to a petroleum hydrocarbon.

(I)

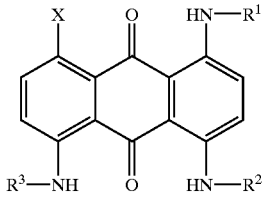

In formula (I), X is $R^4NH$, $NH_2$, OH or halo; and $R^1$, $R^2$, $R^3$ and $R^4$ independently are alkyl, aryl, aralkyl, heteroalkyl or heterocyclic. Preferably, at least two of $R^1$, $R^2$, and $R^3$ are aryl or aromatic heterocyclic. More preferably, X is $R^4NH$, and at least three of $R^1$, $R^2$, $R^3$ and $R^4$ are aryl or aromatic heterocyclic. Most preferably, all of $R^1$, $R^2$, $R^3$ and $R^4$ are aryl.

In another preferred embodiment of the invention, a dye which is an anthraquinone dimer is added to a petroleum hydrocarbon. Anthraquinone dimers include: (i) substituted derivatives, having $\lambda_{max}$ from 710 to 850 nm, of 6,15-dihydro-5,9,14,18-anthrazinetetrone, shown below,

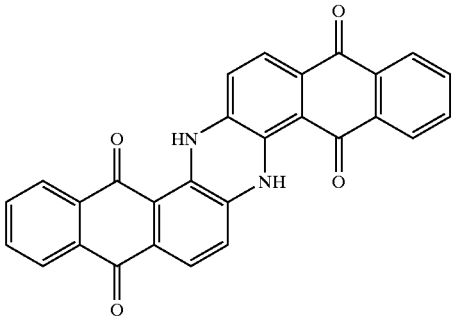

also known by the trade name INDANTHRENE; and (ii) other fused dimers of anthraquinones having extended conjugation and $\lambda_{max}$ from 710 to 850 nm. Preferably, the anthraquinone dimer is a substituted 6,15-dihydro-5,9,14,18-anthrazinetetrone of formula (II).

(II)

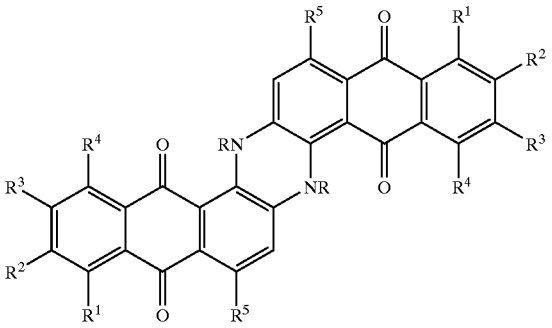

In formula (II), $R^1$, $R^2$, $R^3$, and $R^4$ independently are hydrogen, alkyl, heteroalkyl or alkylamino; $R^5$ is hydrogen, alkyl, heteroalkyl, alkylamino, arylamino or aromatic-heterocyclic-amino; and R is hydrogen, alkyl, arylamino or aromatic-heterocyclic-amino; provided that one of R and $R^5$ is arylamino or aromatic-heterocyclic-amino. Preferably, $R^1$, $R^2$, $R^3$, and $R^4$ are hydrogen.

In one preferred embodiment, $R^1$, $R^2$, $R^3$, $R^4$ and $R^5$ are hydrogen and R is arylamino. Preferably, R is a hydrogen-bond donor arylamino group, e.g., phenylamino. Most preferably, R is phenylamino, such that the compound is of formula (III).

(III)

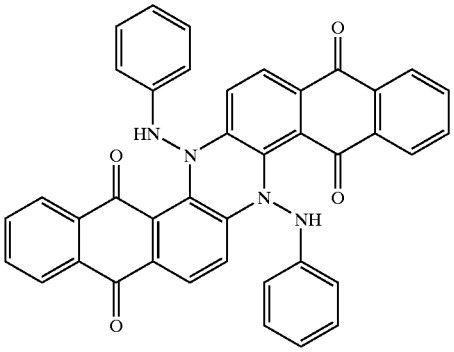

This compound has a $\lambda_{max}$ of 790 nm.

In another preferred embodiment, R, $R^1$, $R^2$, $R^3$, and $R^4$ are hydrogen; and $R^5$ is phenylamino, such that the compound is of formula (IV).

(IV)

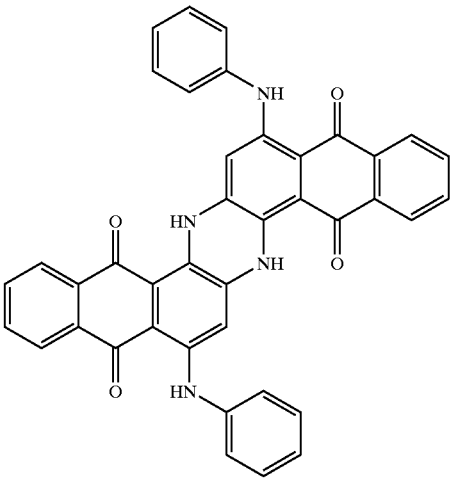

This compound is 6,15-dihydro-8,17-bis(phenylamino)-5,9,14,18-anthrazinetetrone, and has been sold commercially under the trade names C.I. VAT GREEN 6 and CALEDON GREEN RC.

Preferably the amount of each dye added to the petroleum hydrocarbon is at least 0.01 ppm, more preferably at least 0.02 ppm, and most preferably at least 0.03 ppm. Preferably the amount of each dye is less than 10 ppm, more preferably less than 2 ppm, and most preferably less than 1 ppm. Preferably, the marking is invisible, i.e., the dye cannot be detected by simple visual observation of the marked hydrocarbon. Preferably, a dye used in the method of this invention has an absorption maximum in the range from 720 nm to 850 nm, more preferably from 720 nm to 810 nm, and most preferably from 730 nm to 800 nm. Preferably, at least two dyes having absorption maxima at differential wavelengths are added to the petroleum hydrocarbon. Preferably, the dyes are detected by exposing the marked hydrocarbon to electromagnetic radiation having wavelengths in the portion of the spectrum containing the absorption maxima of the dyes and detecting the absorption of light. It is preferred that the detection equipment is capable of calculating dye concentrations and concentration ratios in a marked hydrocarbon. Typical spectrophotometers known in the art are capable of detecting the dyes used in the method of this invention when they are present at a level of at least 0.01 ppm. It is preferred to use the detectors described in U.S. Pat. No. 5,225,679, especially the SpecTrace™ analyzer available from Rohm and Haas Company, Philadelphia, Pa. These analyzers use a filter selected based on the absorption spectrum of the dye, and use chemometric analysis of the signal by multiple linear regression methods to reduce the signal-to-noise ratio.

When the detection method does not involve performing any chemical manipulation of the marked hydrocarbon, the sample may be returned to its source after testing, eliminating the need for handling and disposal of hazardous chemicals. This is the case, for example, when the dyes are detected simply by measuring light absorption by a sample of the marked hydrocarbon.

In one embodiment of the invention, the dye is formulated in a solvent to facilitate its addition to the liquid hydrocarbon. The preferred solvents for tetra-substituted anthraquinones are N-methylpyrrolidinone, N,N-dimethyl propylene urea, nitrobenzene, toluene and N,N-dimethylformamide. Preferably, the dye is present in the solvent at a concentration of from 0.1% to 10%.

EXAMPLES

Example 1

Synthesis of 1,4,5,8-tetra(phenylamino) anthraquinone

A mixture of 10.87 g of 1,4,5,8-tetrachloroanthraquinone, 50 g of aniline, 13.4 g of potassium acetate, 1.24 g of copper sulfate, and 3.41 g of benzyl alcohol was heated to 130° C. under nitrogen and maintained at this temperature for 6.5 hours, followed by another holding period at 170° C. for 6 hours. The reaction mixture was cooled to ambient temperature and the precipitate was filtered to give black solids. Recrystallization of the crude product from toluene afforded 6.0 g of a dark green crystalline material (>95% purity with the structure confirmed by proton NMR as the desired product: 1,4,5,8-tetra(phenylamino)anthraquinone. This material had a maximum absorption band ($\lambda_{max}$) at a wavelength of 750 nm in toluene. The molar extinction coefficient ($\epsilon$) was determined to be ~30,500.

Example 2

Synthesis of 1,4,5,8-tetra(4-n-butylphenylamino) anthraquinone

A mixture of 10.87 g of 1,4,5,8-tetrachloroanthraquinone and 95 g of 4-n-butylaniline was allowed to react at 190° C. for 12 hours. The reaction mixture was then cooled to 70° C. and diluted with an equal amount of ethanol. On standing and further cooling to ambient temperature, some precipitate was formed. The mixture was filtered, washed and recrystallized from xylenes/isopropanol to give 6.6 g of a dark green crystalline material (>95% purity) with the structure confirmed by proton NMR as the desired product of 1,4,5,8-tetra(4-n-butylphenylamino)anthraquinone. This material had a maximum absorption band ($\lambda_{max}$) at a wavelength of 762 nm in toluene. The molar extinction coefficient (ε) was determined to be ~36,900.

Example 3

Detection of Dyes in Petroleum Hydrocarbons

Solutions of 1,4,5,8-tetra(phenylamino)anthraquinone (TPAAQ) in xylenes, Texaco™ diesel fuel and Mobil™ regular gasoline at varying concentrations were prepared and analyzed with a laboratory spectrophotometer. The results are presented in the Table below, with expected and actual readings expressed as a percentage of the reading for 1 mg/mL.

TABLE

| concentration, mg/mL | expected reading | actual reading |
|---|---|---|
| | TPAAQ in xylenes | |
| 2.045 | 204 | 208 |
| 1.063 | 106 | 105 |
| 0.983 | 98 | 98 |
| 0.703 | 70 | 71 |
| 0.402 | 40 | 40 |
| 0.073 | 7 | 8 |
| 0.035 | 4 | 3 |
| | TPAAQ in Texaco ™ diesel fuel | |
| 1.35 | 135 | 135 |
| 1.09 | 109 | 109 |
| 0.84 | 84 | 85 |
| 0.58 | 58 | 56 |
| 0.33 | 33 | 33 |
| 0.05 | 5 | 4 |
| | TPAAQ in Mobil ™ regular gasoline | |
| 1.335 | 133 | 134 |
| 0.934 | 93 | 92 |
| 0.565 | 56 | 57 |
| 0.389 | 39 | 38 |
| 0.059 | 6 | 5 |
| 0.048 | 5 | 5 |

What is claimed is:

1. A method for invisibly marking a liquid petroleum hydrocarbon; said method comprising adding to said liquid petroleum hydrocarbon at least one dye selected from the group consisting of 1,4,5,8-tetrasubstituted anthraquinones and anthraquinone dimers; wherein said at least one dye has an absorption maximum in the range from 710 nm to 850 nm; and wherein each dye is present in an amount less than 2 ppm.

2. The method of claim 1 in which the liquid petroleum hydrocarbon is selected from the group consisting of lubricating oil, brake fluid, hydraulic fluid, gasoline, diesel fuel, kerosene, jet fuel and heating oil.

3. The method of claim 2 in which said at least one dye has formula (I)

(I)

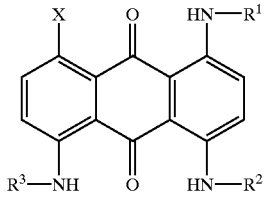

wherein X is $R^4NH$, $NH_2$, OH or halo; and $R^1$, $R^2$, $R^3$ and $R^4$ independently are alkyl, aryl, aralkyl, heteroalkyl or heterocyclic.

4. The method of claim 3 in which X is $R^4NH$, and at least three of $R^1$, $R^2$, $R^3$ and $R^4$ are aryl or aromatic heterocyclic.

5. The method of claim 2 in which said at least one dye has formula (II)

(II)

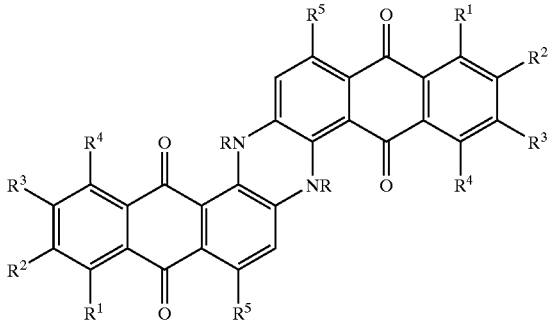

wherein $R^1$, $R^2$, $R^3$, and $R^4$ independently are hydrogen, alkyl. heteroalkyl or aikylamino; $R^5$ is hydrogen, alkyl, heteroalkyl, aikylamino, arylamino or aromatic-heterocyclic-amino; and R is hydrogen, alkyl, arylamino or aromatic-hetercyclic-amino; provided that at least one of R and $R^5$ is arylamino or aromatic-heterocyclic-amino.

6. A method for invisibly marking a liquid petroleum hydrocarbon; said method comprising adding to said liquid petroleum hydrocarbon a dye of formula (I)

(I)

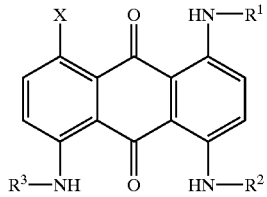

wherein X is $R^4NH$, $NH_2$, OH or halo; $R^1$, $R^2$, $R^3$ and $R^4$ independently are alkyl, aryl, aralkyl, heteroalkyl or heterocyclic; at least three of $R^1$, $R^2$, $R^3$ and $R^4$ are aryl groups; wherein said dye is present in an amount less than 2 ppm; and said dye has an absorption maximum in the range from 720 nm to 810 nm.

7. The method of claim 6 in which X is $R^4NH$; $R^1$, $R^2$, $R^3$ and $R^4$ independently are aryl or aromatic heterocyclic; the liquid petroleum hydrocarbon is selected from the group consisting of lubricating oil, brake fluid, hydraulic fluid, gasoline, diesel fuel, kerosene, jet fuel and heating oil; further comprising a step of detecting the dye without performing any chemical manipulation of the liquid petroleum hydrocarbon.

8. A method for invisibly marking a liquid petroleum hydrocarbon; said method comprising adding to said liquid petroleum hydrocarbon a dye of formula (II)

(II)

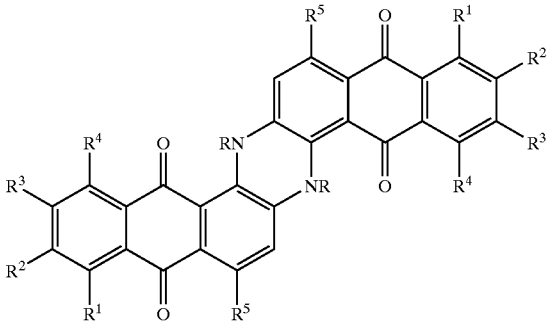

wherein $R^1$, $R^2$, $R^3$, and $R^4$ independently are hydrogen, alkyl, heteroalkyl or alkylamino; $R^5$ is hydrogen, alkyl, heteroalkyl, alkylamino, arylamino or aromatic-heterocyclic-amino; and R is hydrogen, alkyl, arylamino or aromatic-heterocyclic-amino; provided that one of R and $R^5$ is arylamino or aromatic-heterocyclic-amino; and said dye has an absorption maximum in the range from 720 nm to 810 nm.

9. The method of claim 8 in which R, $R^1$, $R^2$, $R^3$, and $R^4$ are hydrogen; $R^5$ is arylamino; the liquid petroleum hydrocarbon is selected from the group consisting of lubricating oil, brake fluid, hydraulic fluid, gasoline, diesel fuel, kerosene, jet fuel and heating oil; further comprising a step of detecting the dye without performing any chemical manipulation of the liquid petroleum hydrocarbon.

10. The method of claim 7 in which the liquid petroleum hydrocarbon is selected from the group consisting of lubricating oil, brake fluid and hydraulic fluid.

11. The method of claim 10 in which the liquid petroleum hydrocarbon is lubricating oil.

12. The method of claim 11 which the dye is detected by measuring light absorption by a sample of the lubricating oil.

* * * * *